US010940996B2

(12) United States Patent
O'Rear

(10) Patent No.: US 10,940,996 B2
(45) Date of Patent: Mar. 9, 2021

(54) WASTE RECEPTACLE

(71) Applicant: Jennifer O'Rear, Suwanee, GA (US)

(72) Inventor: Jennifer O'Rear, Suwanee, GA (US)

( * ) Notice: Subject to any disclaimer, the term of this patent is extended or adjusted under 35 U.S.C. 154(b) by 0 days.

(21) Appl. No.: 16/378,896

(22) Filed: Apr. 9, 2019

(65) Prior Publication Data

US 2019/0308808 A1 Oct. 10, 2019

Related U.S. Application Data

(60) Provisional application No. 62/655,466, filed on Apr. 10, 2018.

(51) Int. Cl.
*B65F 1/06* (2006.01)
*B65F 1/16* (2006.01)

(52) U.S. Cl.
CPC ..... *B65F 1/068* (2013.01); *B65F 1/163* (2013.01); *B65F 2240/136* (2013.01)

(58) Field of Classification Search
CPC .... B65F 1/00; B65F 1/06; B65F 1/068; B65F 1/14; B65F 1/1415; B65F 1/1421; B65F 1/1431; B65F 1/10; B65F 1/16; B65F 1/163; B65F 1/1607; B65F 1/1653; B65F 2001/1653
See application file for complete search history.

(56) References Cited

U.S. PATENT DOCUMENTS

| | | | | |
|---|---|---|---|---|
| 3,927,445 | A * | 12/1975 | Pavlish | B65F 1/06 24/482 |
| 5,158,199 | A | 10/1992 | Pontius | |
| 7,219,705 | B2 | 5/2007 | Wallek | |
| 7,748,556 | B2 | 7/2010 | Yang et al. | |
| 8,136,688 | B2 | 3/2012 | Lee | |
| 9,181,028 | B1 | 11/2015 | Stravitz | |
| 10,053,283 | B1 * | 8/2018 | Stravitz | B65F 7/00 |
| 2005/0044819 | A1 | 3/2005 | Chomik et al. | |
| 2014/0054293 | A1 * | 2/2014 | Goodfield | B65F 1/1426 220/495.06 |

* cited by examiner

*Primary Examiner* — Don M Anderson
(74) *Attorney, Agent, or Firm* — Asgaard Patent Services, LLC; F. Wayne Thompson, Jr.

(57) ABSTRACT

Implementations of a waste receptacle are provided. The waste receptacle is an outdoor container configured to temporarily store dog waste, in particular, disposable plastic bags containing dog waste. In some implementations, the waste receptacle is configured to hold a trash bag so that it can be easily filled with dog waste and/or other refuse. In some implementations, the waste receptacle comprises a body, a trash chute member having a hinged cover that provides selective access to the interior of the body, a lid configured to cover the trash chute member, and a keeper configured to secure the mouth of a trash bag about a conduit extending from the bottom side of the trash chute member. In some implementations, the waste receptacle may further comprise a foot pedal that is operably coupled to the lid. In this way, the lid can be opened by stepping on the foot pedal.

6 Claims, 17 Drawing Sheets

WASTE RECEPTACLE

CROSS REFERENCE TO RELATED APPLICATION

This application claims the benefit of U.S. Provisional Application Ser. No. 62/655,466, which was filed on Apr. 10, 2018, the entirety of which is incorporated herein by reference.

TECHNICAL FIELD

This disclosure relates to implementations of a waste receptacle.

BACKGROUND

Waste receptacles, e.g., trash cans, are common in kitchens and other household locations, and other locations where waste is generated and needs to be disposed of in a sanitary manner. Waste receptacles are also used to dispose of household waste, such as pet waste. Often, waste receptacles are equipped with a lid designed to contain odors when the lid is closed. However, most lids are not perfectly airtight in respect to their receptacle and permit malodor to emanate from the receptacle. As such, waste receptacles are often positioned outside of the home. Unfortunately, most commercially available waste receptacles are not aesthetically pleasing. Further, many outdoor waste receptacles are not configured so that a user can dispose of waste without touching the lid of the receptacle.

Accordingly, it can be seen that needs exist for the waste receptacle disclosed herein. It is to the provision of a waste receptacle that is configured to address these needs, and others, that the present invention is primarily directed.

SUMMARY OF THE INVENTION

Implementations of a waste receptacle are provided. The waste receptacle is a container configured to temporarily store dog waste, in particular, disposable plastic bags containing dog waste. In some implementations, the waste receptacle is configured to hold a trash bag so that it can be easily filled with dog waste and/or other refuse.

In some implementations, the waste receptacle comprises a body, a trash chute member having a hinged cover that provides selective access to the interior of the body, a lid configured to cover the trash chute member, and a keeper configured to secure the mouth of a trash bag about a conduit extending from the bottom side of the trash chute member. In some implementations, the waste receptacle may further comprise a foot pedal that is operably coupled to the lid. In this way, the lid can be opened by stepping on the foot pedal.

In some implementations, the trash chute member may include a pair of horizontal doors configured to provide selective access to the interior of the body.

In some implementations, the waste receptacle may further comprise detachable stakes that are secured to an underside thereof. The detachable stakes are configured to prevent the waste receptacle from easily tipping over.

In another implementation, the waste receptacle comprises a body, a trash chute member having a hinged cover that is configured to provide selective access to the interior of the body, a lid configured to cover the trash chute member, and an elastic keeper configured to secure the mouth of a trash bag about a conduit extending from the bottom side of the trash chute member. In some implementations, the waste receptacle may further comprise a foot pedal configured to open the lid of the waste receptacle.

BRIEF DESCRIPTION OF THE DRAWINGS

Like reference numerals refer to corresponding parts throughout the several views of the drawings.

DETAILED DESCRIPTION

Figure 1:
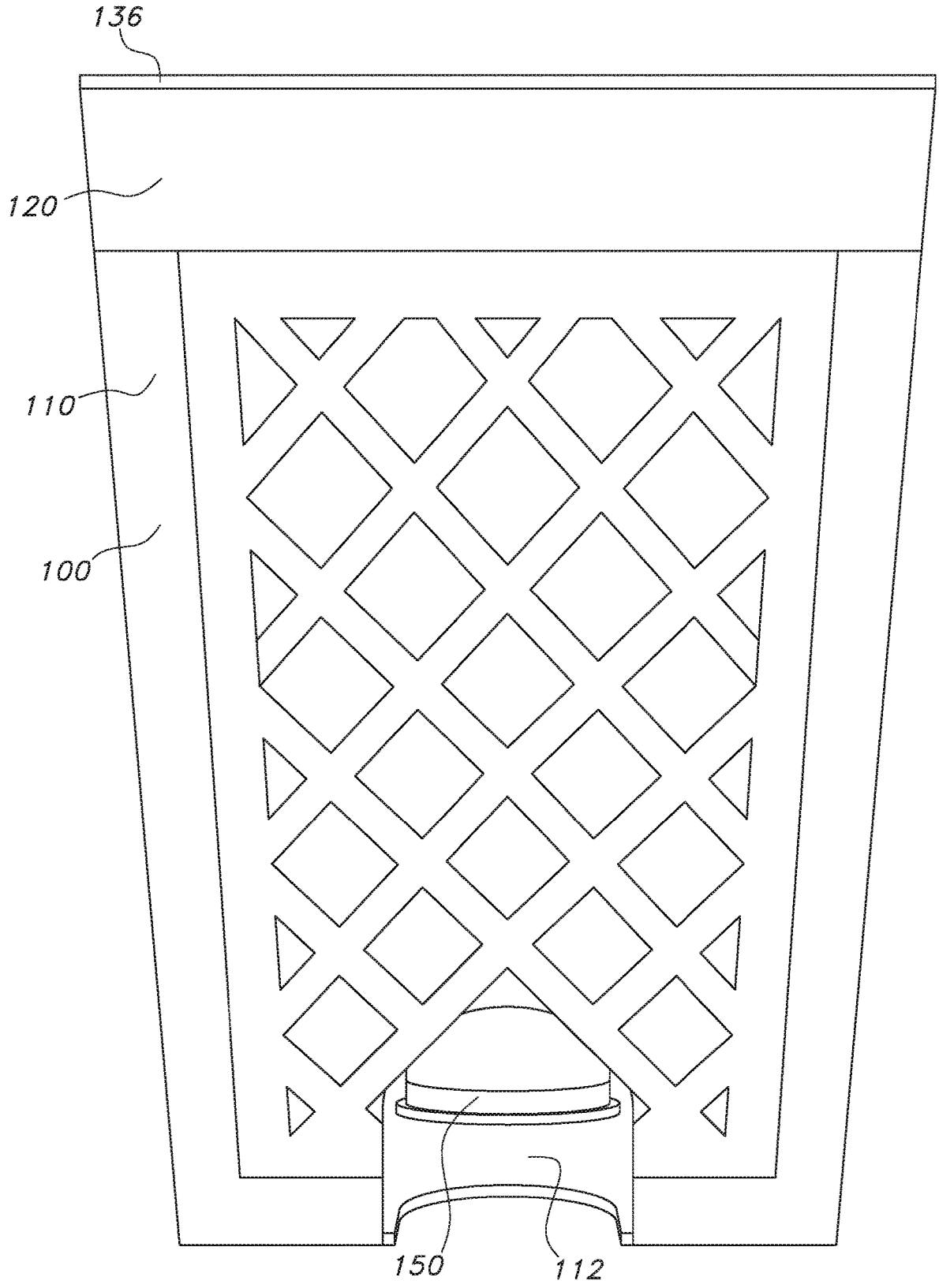
FIG. 1 illustrates a perspective view of a waste receptacle constructed in accordance with the principles of the present disclosure.

FIGS. 1, 2A-2B, and 3A-3B illustrate a waste receptacle 100 constructed in accordance with the principles of the present disclosure. In some implementations, the waste receptacle 100 may be a container configured to temporarily store dog waste, in particular, disposable plastic bags containing dog waste. In some implementations, the waste receptacle 100 may be configured to hold a trash bag 105 and to allow the trash bag 105 to be easily filled with dog waste and/or other refuse.

As shown in FIGS. 1, 2A-2B, and 3A-3B, in some implementations, the waste receptacle 100 may comprise a body 110, a trash chute member 120 having a hinged cover 130 providing selective access to the interior of the body 110, a lid 136 configured to cover the trash chute member 120, and a keeper 140 configured to secure the mouth of a trash bag 105 about the exterior of a conduit 126 extending from the bottom side of the trash chute member 120. In some implementations, the waste receptacle 100 may further comprise a foot pedal 150 configured to open the lid 136 of the waste receptacle 100.

Figure 3A:
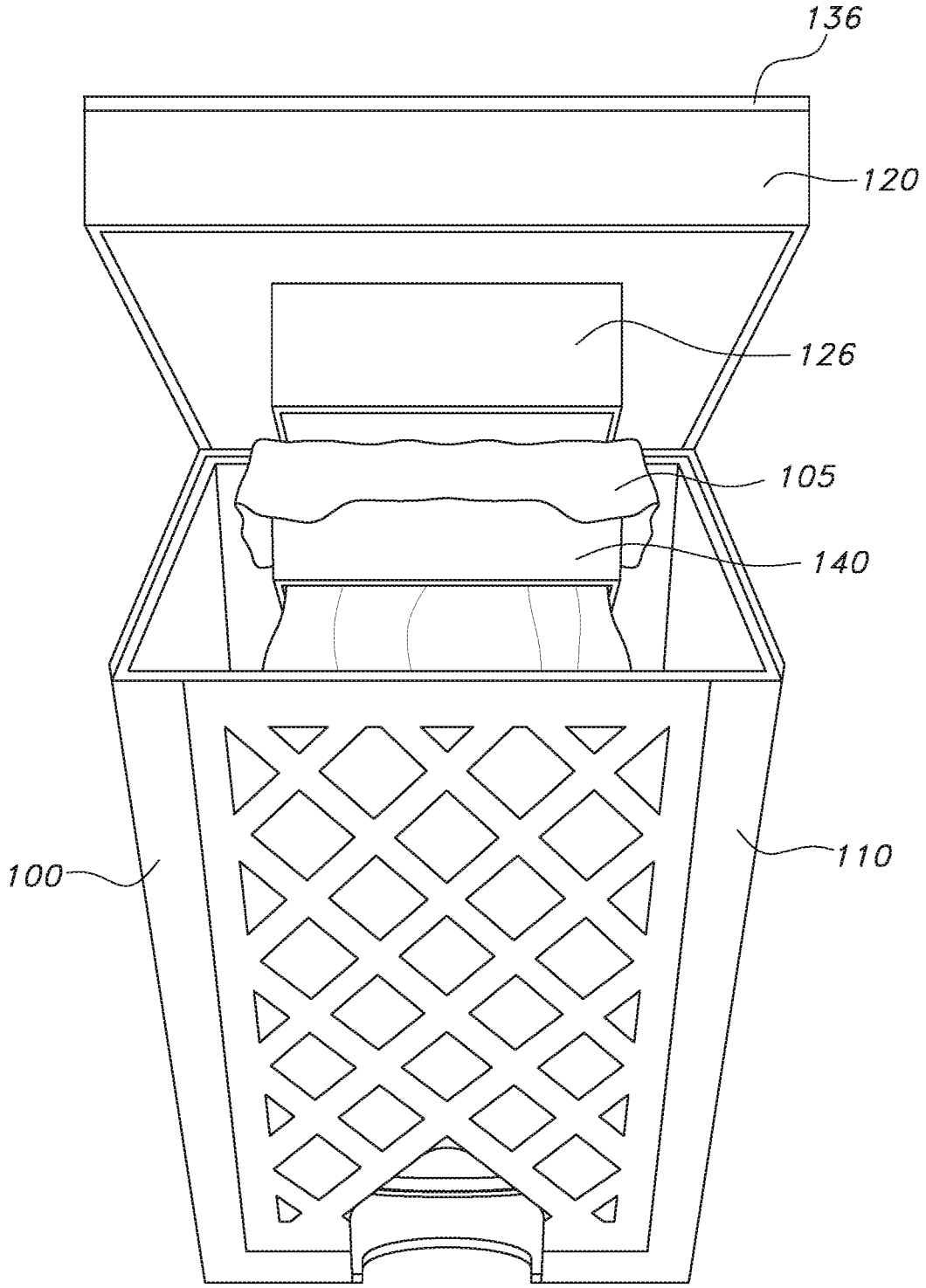
FIG. 3A illustrates a perspective view of the waste receptacle shown in FIG. 1, wherein the trash chute member is in the open position and a trash bag is shown positioned on a keeper.
Figure 3B:
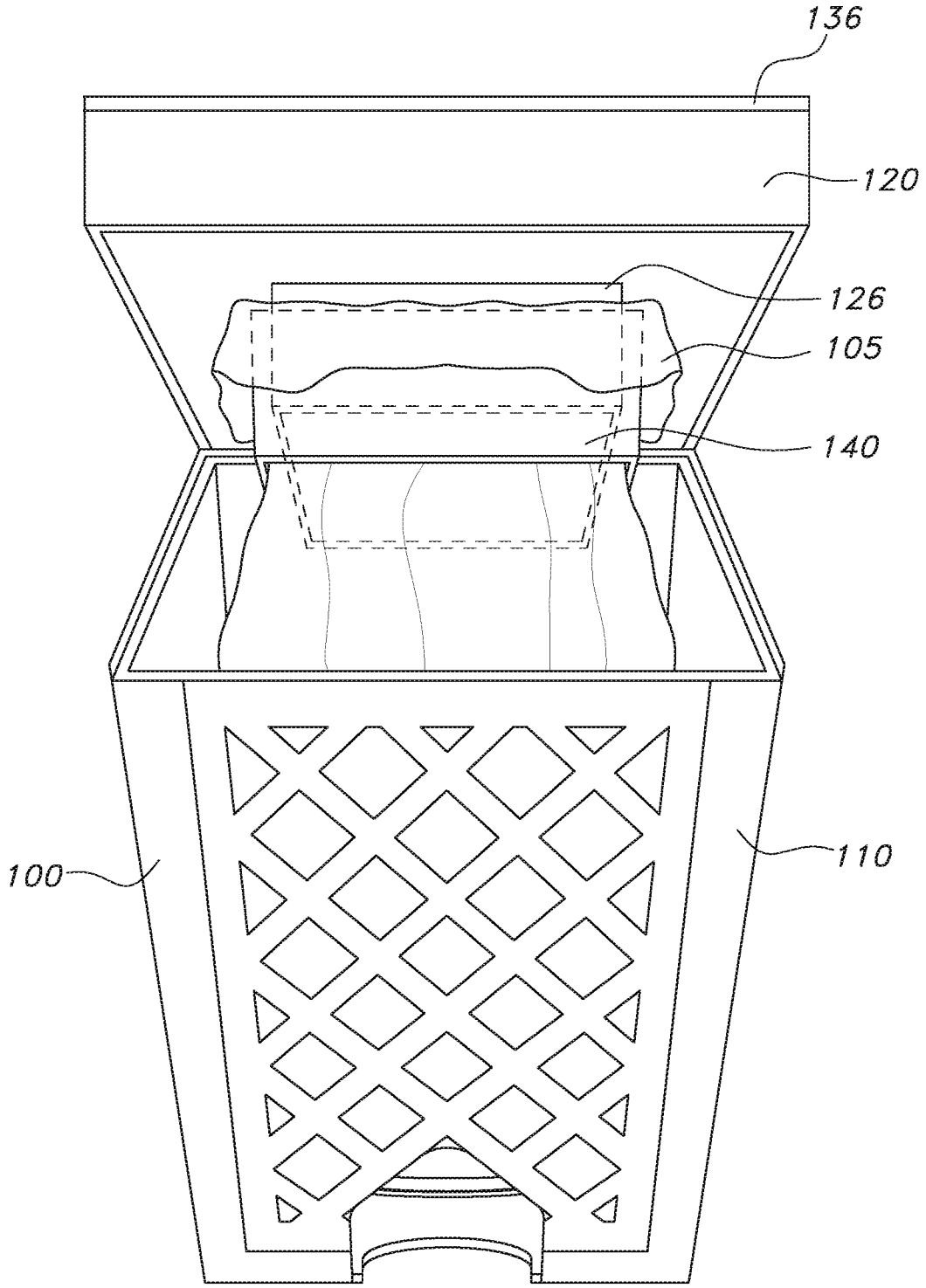
FIG. 3B illustrates a perspective view of the waste receptacle shown in FIG. 3A, wherein the mouth of the trash bag is secured about the exterior of the conduit by the keeper.
Figure 4A:
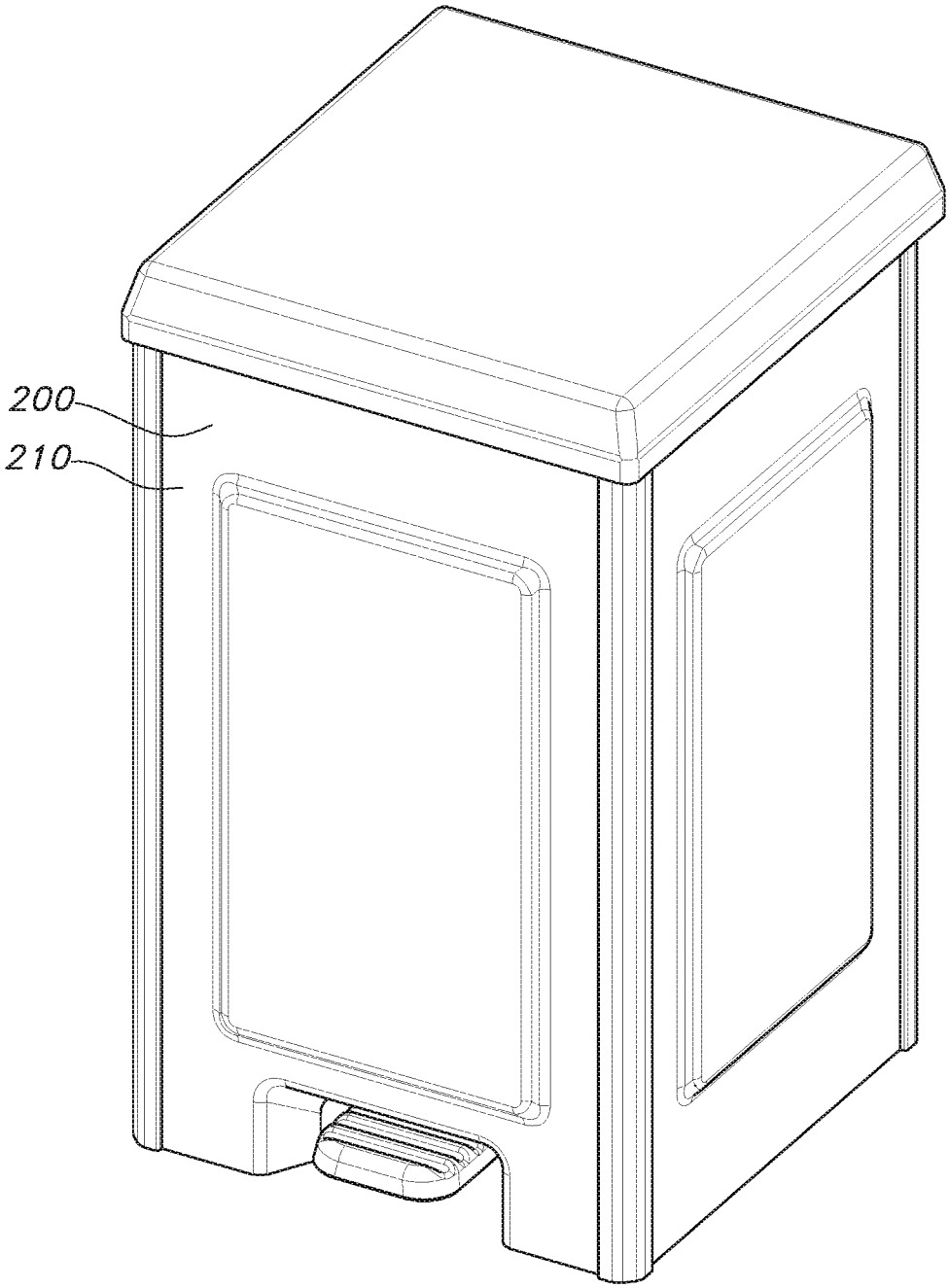
FIG. 4A illustrates a front, top, right side isometric view of another waste receptacle constructed in accordance with the principles of the present disclosure.
Figure 4B:
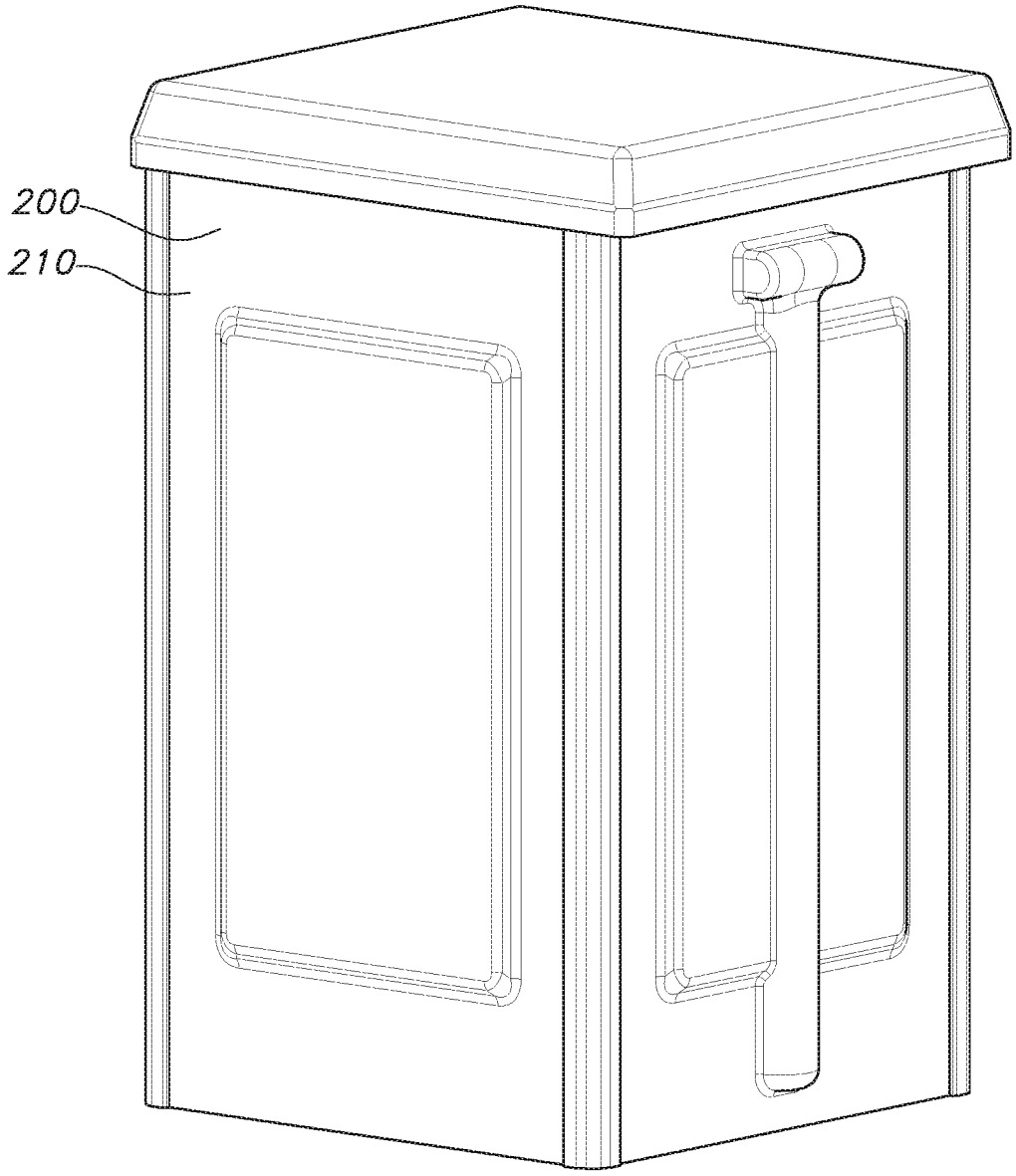
FIG. 4B illustrates a rear, top, right side view of the waste receptacle shown in FIG. 4A.

In some implementations, the body 110 of the waste receptacle 100 may be substantially square in shape and have sufficient inner volume to contain a trash bag 105 therein (see, e.g., FIGS. 3A and 3B). In some implementations, the body 110 may have a rectangular shape, round shape, or any other shape suitable for housing a trash bag therein. In some implementations, the body 110 may be decorative in appearance (see, e.g., FIG. 1). In this way, when positioned outside of the home, the waste receptacle 100 is aesthetically pleasing.

Figure 5A:
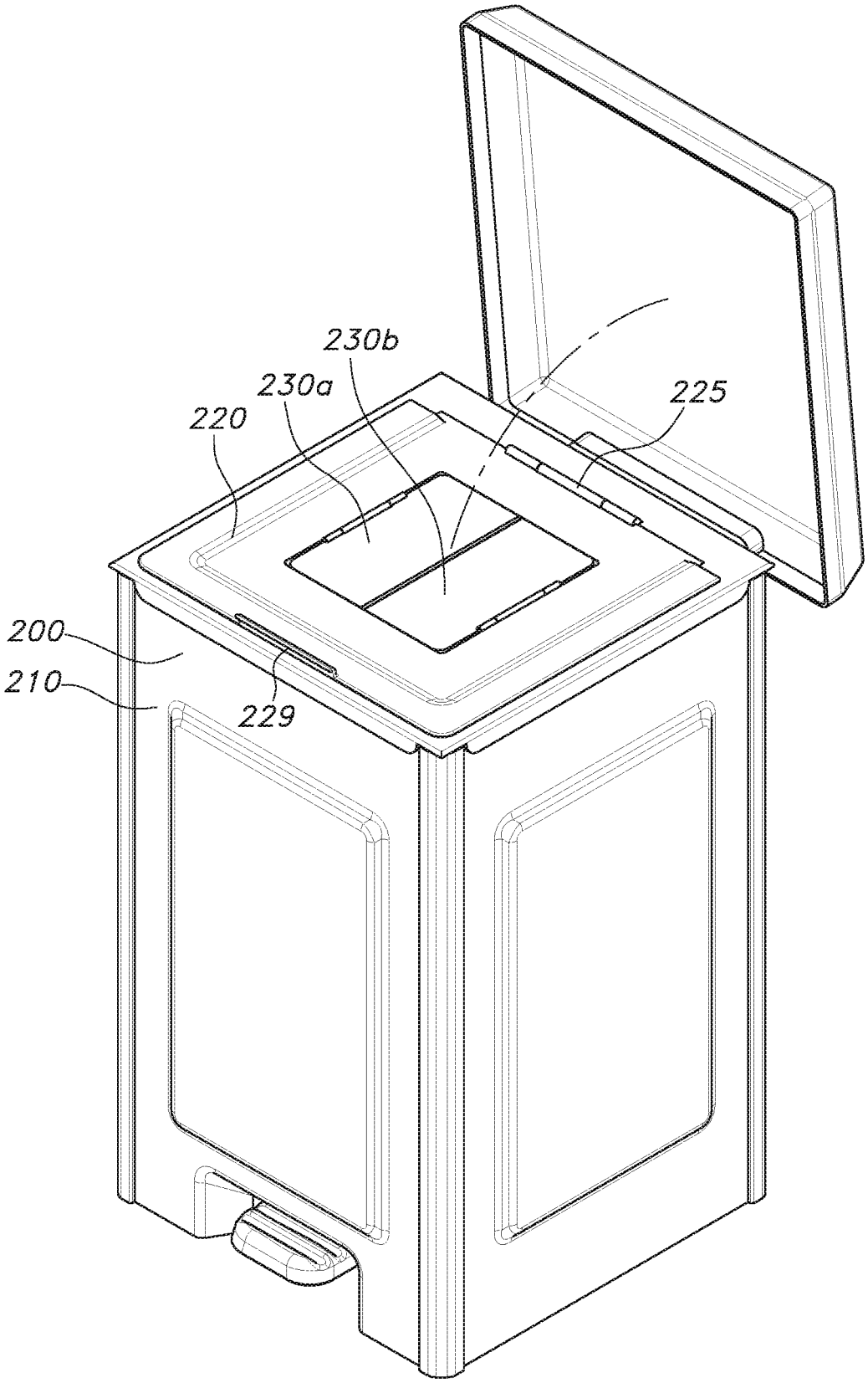
FIG. 5A illustrates an isometric view of the waste receptacle shown in FIG. 4A, wherein the top lid is open.

In some implementations, the trash chute member 120 may be attached to the body 110 of the waste receptacle 100 by a hinge (see, e.g., element 225 in FIG. 5A). In some implementations, the hinge may be configured to allow the trash chute member 120 to be moved between an open position (see, e.g., FIG. 3A) and a closed position (see, e.g., FIG. 1). One of ordinary skill in the art having the benefit of the present disclosure, would be able to select an appropriate hinge.

Figure 2A:
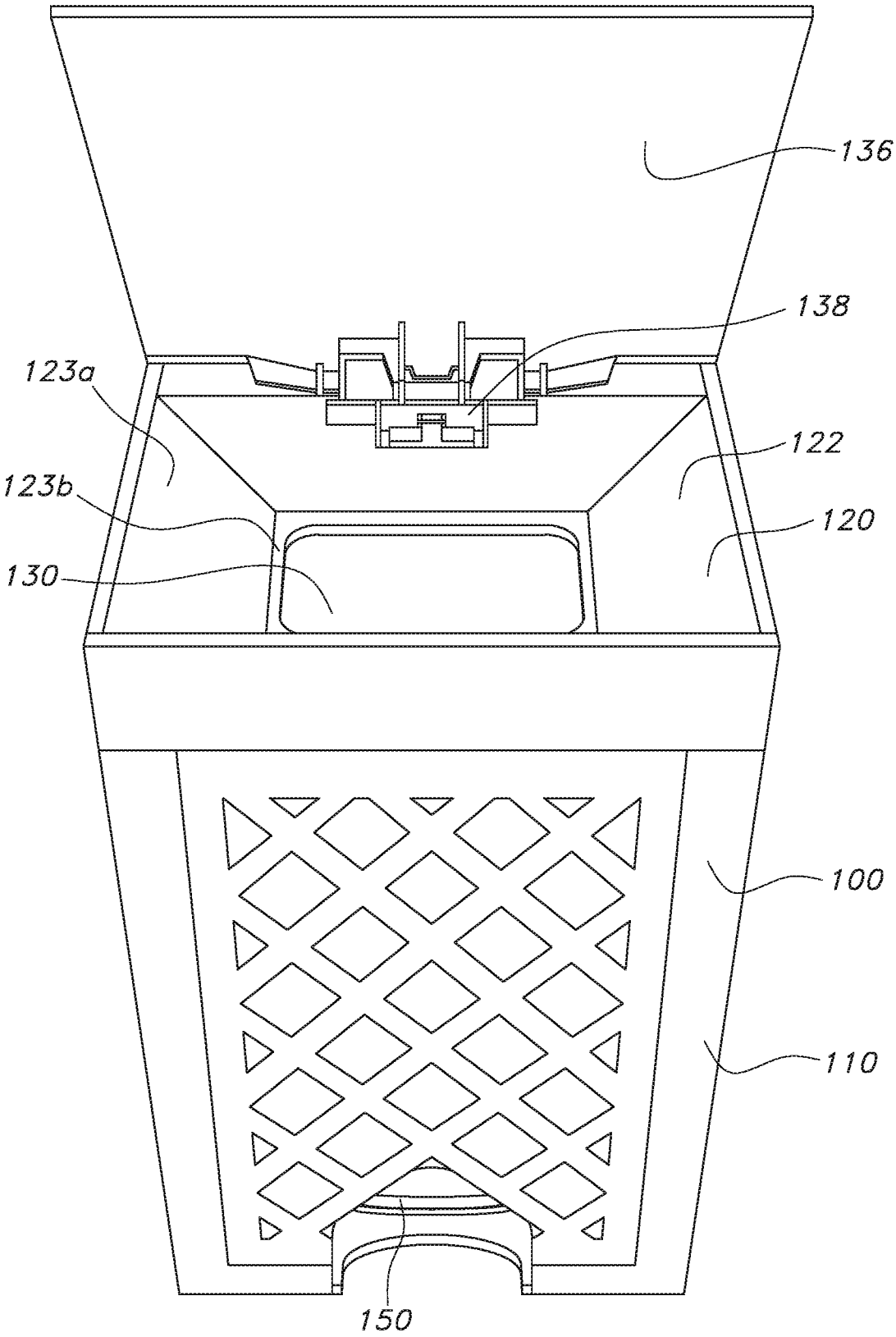
FIG. 2A illustrates a perspective view of the waste receptacle shown in FIG. 1, wherein the top lid is open.
Figure 2B:
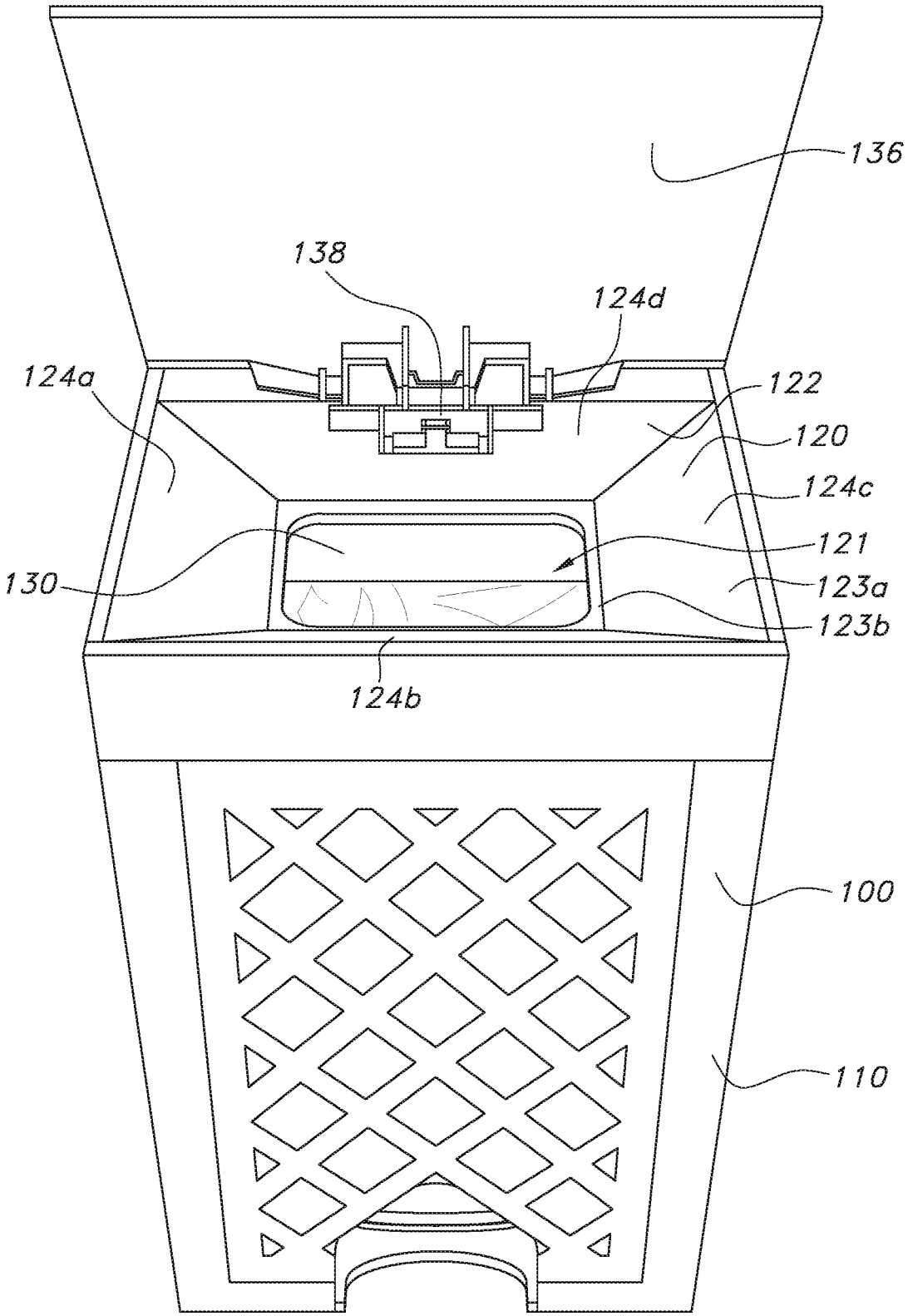
FIG. 2B illustrates a perspective view of the waste receptacle shown in FIG. 2A, wherein the hinged cover of the trash chute member is open.

As shown in FIGS. 2A and 2B, in some implementations, the trash chute member 120 may include a funnel 122 configured to guide waste and/or other refuse into the trash bag 105 contained within the body 110 of the waste receptacle 100. In some implementations, the funnel 122 may comprise a first substantially planar sidewall 124*a*, a second substantially planar sidewall 124*b*, a third substantially planar sidewall 124*c*, and a fourth substantially planar sidewall 124*d* that are joined together at substantially right angles to each other (see, e.g., FIG. 2B). In some implementations, the sidewalls 123 taper inwardly from a first end 123*a* of the funnel 122 to a second end 123*b* thereof. In some implementations, the cross-sectional area of the passageway at the first end 123*a* of the funnel 122 is larger than the cross-sectional area of the passageway at the second end 123*b* of the funnel 122. In some implementations, the funnel 122 may be constructed in any manner suitable for guiding waste and/or other refuse into the trash bag 105 contained within the body 110 of the waste receptacle 100. In some implementations, the trash chute member 120 may not include a funnel 122.

As shown in FIGS. 2A and 2B, in some implementations, the hinged cover 130 of the trash chute member 120 may be configured to provide selective access to the opening 121 defined by the funnel 122 and the conduit 126. In some implementations, the hinged cover 130 can be pivoted downwardly to permit waste and/or other refuse to be placed into the trash bag 105 housed within the body 110. In some implementations, the hinged cover 130 may be pivotally supported by the trash chute member 120 in a horizontal position to form a swinging door-like closure. In some implementations, the hinged cover 130 may be biased to return to the horizontal position by a spring and/or another suitable mechanism known to one of ordinary skill in the art.

As shown in FIG. 3A, in some implementations, the conduit 126 extending from the bottom side of the trash chute member 120 may be positioned so that the opening therethrough is aligned with the passageway defined by the funnel 122. In this way, waste and/or other refuse passing through the hinged cover 130 can pass through the conduit 126 and into the trash bag 105 (see, e.g., FIG. 3B). In some implementations, the conduit 126 may have a rectangular shape. In some implementations, the conduit 126 may be any shape suitable for the mouth of a trash bag 105 to be secured thereto by a keeper 140.

As shown in FIGS. 2A and 2B, in some implementations, the lid 136 may be attached to the trash chute member 120 by a hinge 138. In some implementations, the hinge 138 may be configured to allow the lid 136 to be moved between an open position (see, e.g., FIG. 2A) and a closed position (see, e.g., FIG. 1). One of ordinary skill in the art, having the benefit of the present disclosure, would be able to select an appropriate hinge 138.

While the lid 136 may be lifted and lowered manually, in some implementations, the waste receptacle 100 includes a foot pedal 150 that is operably coupled to the lid 136 (see, e.g., FIG. 1). In this way, the lid 136 can be opened by stepping on the foot pedal 150. In some implementations, the lid 136 may close once the user removes their foot from the foot pedal 150. In some implementations, the foot pedal 150 may protrude into a pedal housing 112 located within a frontside of the body 110. In some implementations, the pedal housing 112 has a height and width that allows a user to slide their foot into the pedal housing 112 and onto the foot pedal 150. The linking mechanism operably coupling the foot pedal 150 to the lid 136 is not critical to the design of the present invention. Therefore, the waste receptacle 100 could be configured to include any suitable linking mechanism, known to one of ordinary skill in the art, that is capable of lifting the lid 136 when the foot pedal 150 is stepped on.

As shown in FIG. 3B, in some implementations, the keeper 140 may have the same shape as the exterior of the conduit 126 extending from the underside of the trash chute member 120 and be dimensioned relative thereto, i.e., with its inner opening slightly larger than the exterior of the conduit 126, to provide a tight fit for the trash bag 105 therebetween. This tight fit secures the trash bag 105 to the trash chute member 120 and should prevent unintentional release of the trash bag 105 from engagement with the conduit 126. In some implementations, the keeper 140 may have a square shape and be configured to fit snugly about the exterior of the conduit 126 extending from the bottom side of the trash chute member 120. In this way, the mouth of the trash bag 105 can be secured about the conduit 126.

In some implementations, the following steps may be used to secure the mouth of a trash bag 105 in position about the conduit 126 extending from the bottom side of the trash chute member 120.

Initially, in some implementations, the trash chute member 120 of the waste receptacle 100 may be moved to the open position (see, e.g., FIG. 3A).

Then, in some implementations, the mouth of the trash bag 105 may be inserted through the interior opening of the keeper 140 and folded over the lip thereof (see, e.g., FIG. 3A).

Next, in some implementations, the keeper 140, with the mouth of the trash bag 105 folded over the lip thereof, may be positioned about the exterior of the conduit 126. In this way, the snug fit between the keeper 140 and the conduit 126 holds the trash bag 105 in position about the conduit 126 (see, e.g., FIG. 3B).

In some implementations, the trash bag 105 may be removed from engagement with the conduit 126 by simply grasping it about the neck portion and pulling. This will dislodge the mouth portion of the trash bag 105, and the keeper 140, from the conduit 126 of the trash chute member 120. The trash bag 105, presumably containing waste and/or other refuse, can now be discarded.

FIGS. 4A-4B, 5A-5B, and 6 illustrate another example implementation of a waste receptacle 200 constructed in accordance with the present disclosure. In some implementations, the waste receptacle 200 is similar to the waste receptacle 100 discussed above but the trash chute member 220 includes a pair of horizontal doors 230*a*, 230*b* configured to provide selective access to the interior of the body 210 and the keeper 240 used to secure the mouth of a trash bag about the conduit 226 of the trash chute member 220 may be a wire clamp. In some implementations, the waste receptacle 200 may further comprise detachable stakes 216 configured to prevent the waste receptacle 200 from tipping over, for example, due to high wind (see, e.g., FIG. 7).

Figure 5B:
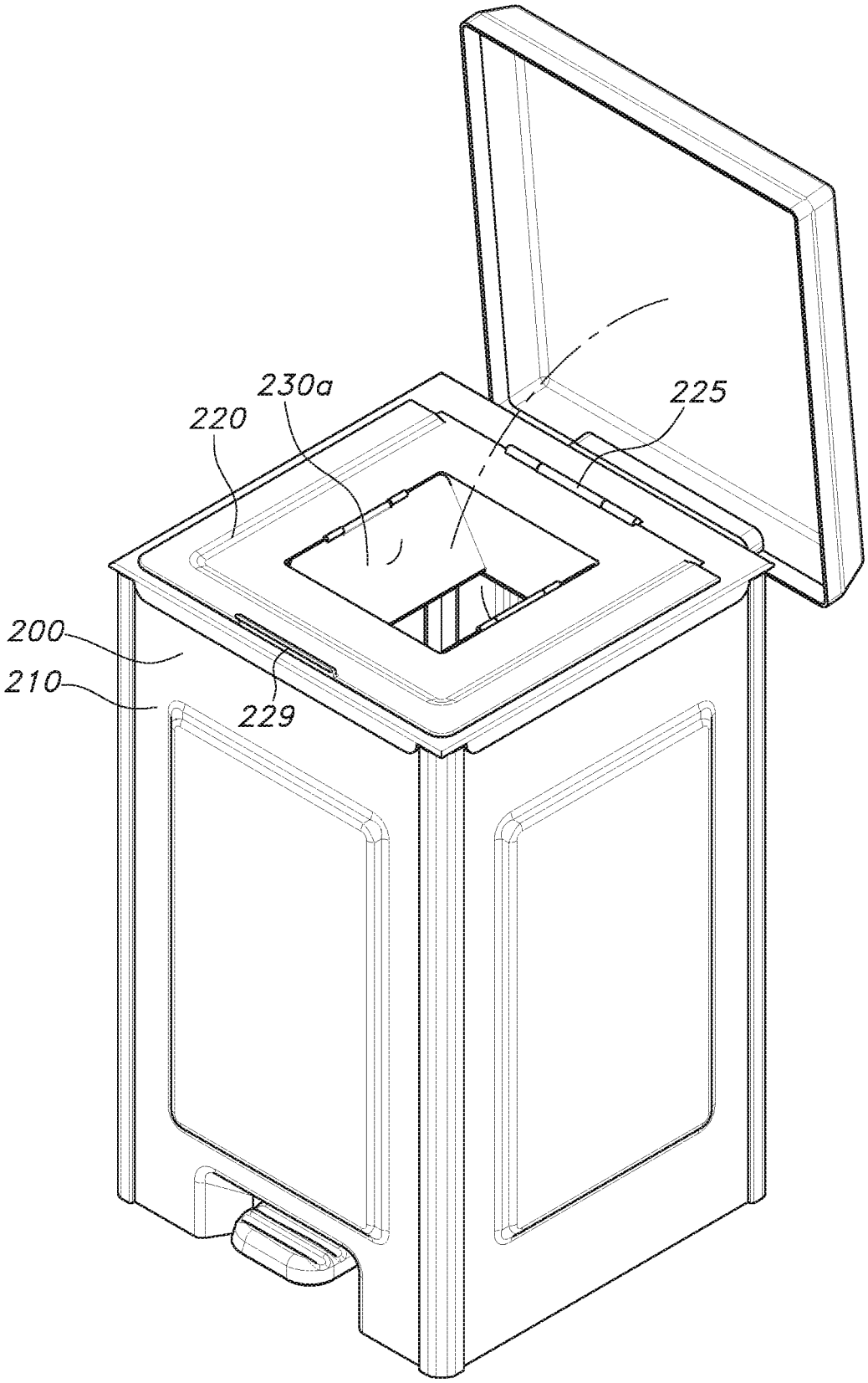
FIG. 5B illustrates an isometric view of the waste receptacle shown in FIG. 5A, wherein the hinged doors of the trash chute member are open.

As shown in FIGS. 5A and 5B, in some implementations, each door 230*a*, 230*b* may be pivotally supported by the trash chute member 220 in a horizontal position such that each door 230*a*, 230*b* can be pivoted downwardly to permit a bag of waste and/or other refuse to be placed into a trash bag contained within the body 210 of the waste receptacle 200. In some implementations, each door 230*a*, 230*b* may be biased to return to the horizontal position by a spring and/or another suitable mechanism known to one of ordinary skill in the art.

Figure 6:
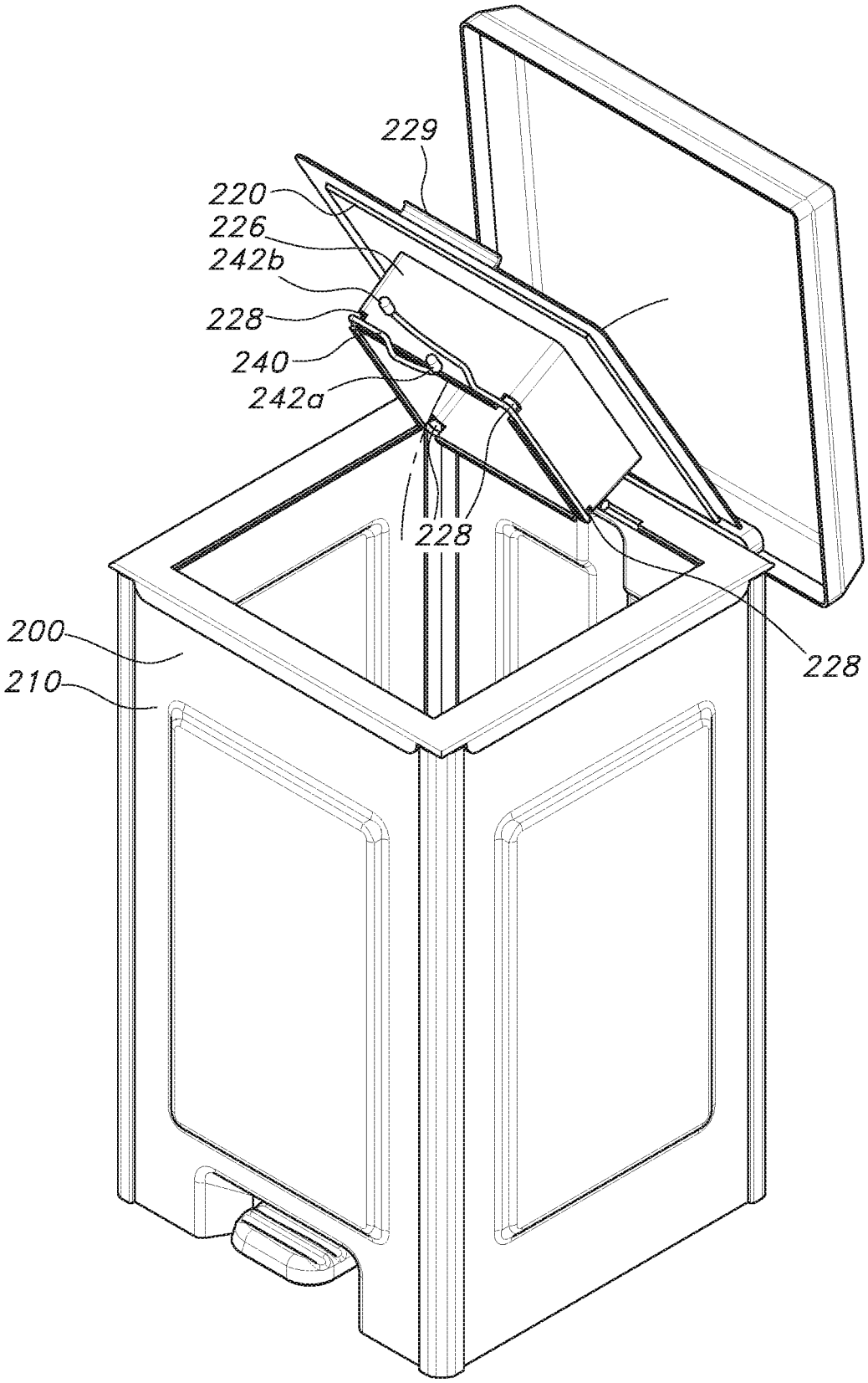
FIG. 6 illustrates an isometric view of the waste receptacle shown in FIG. 5A, wherein the trash chute member is in the open position.

As shown in FIG. 6, in some implementations, the keeper 240 may be a wire clamp configured to fit about the conduit 226 extending from the bottom side of the trash chute member 220. In some implementations, the wire clamp 240 may be a resilient piece of material (e.g., a steel alloy) having a first end 242*a* and a second end 242*b*. In some implementations, the wire clamp 240 may be configured to interface with grooves 228 located within each corner of the conduit 126 extending from the bottom side of the trash chute member 220. In this way, the wire clamp 240 may be used to secure the mouth of a trash bag about the conduit 226.

In some implementations, the following steps may be used to secure the mouth of a trash bag in position about the conduit 226 extending from the bottom side of the trash chute member 220.

Initially, in some implementations, the trash chute member 220 of the waste receptacle 200 may be moved to the open position using the provided handle 229 (see, e.g., FIG. 6).

Then, in some implementations, the mouth of the trash bag may be inserted through the interior opening of the wire clamp 240 and folded thereover (not shown).

Next, in some implementations, the wire clamp 240, with the mouth of the trash bag folded thereover, may be expanded to fit about the exterior of the conduit 226 by pulling the first end 242*a* and the second end 242*b* thereof apart.

Then, in some implementations, the expanded wire clamp 240 may be positioned about the conduit 226 so that the body thereof is received within the grooves 228 of the conduit 226 when the ends 242*a*, 242*b* are released. In this way, the mouth of the trash bag may be held in position about the conduit 226 by the wire clamp 240.

In some implementations, the following steps may be used to remove the wire clamp 240 from engagement with the conduit 226.

Initially, in some implementations, the first end 242*a* and the second end 242*b* of the wire clamp 240 may be pulled apart thereby removing the body of the wire clamp 240 from the grooves 228 in the conduit 226.

Then, the wire clamp 240 may be withdrawn from the conduit 226 and the attendant trash bag, presumably containing waste and/or other refuse, discarded.

Figure 7:
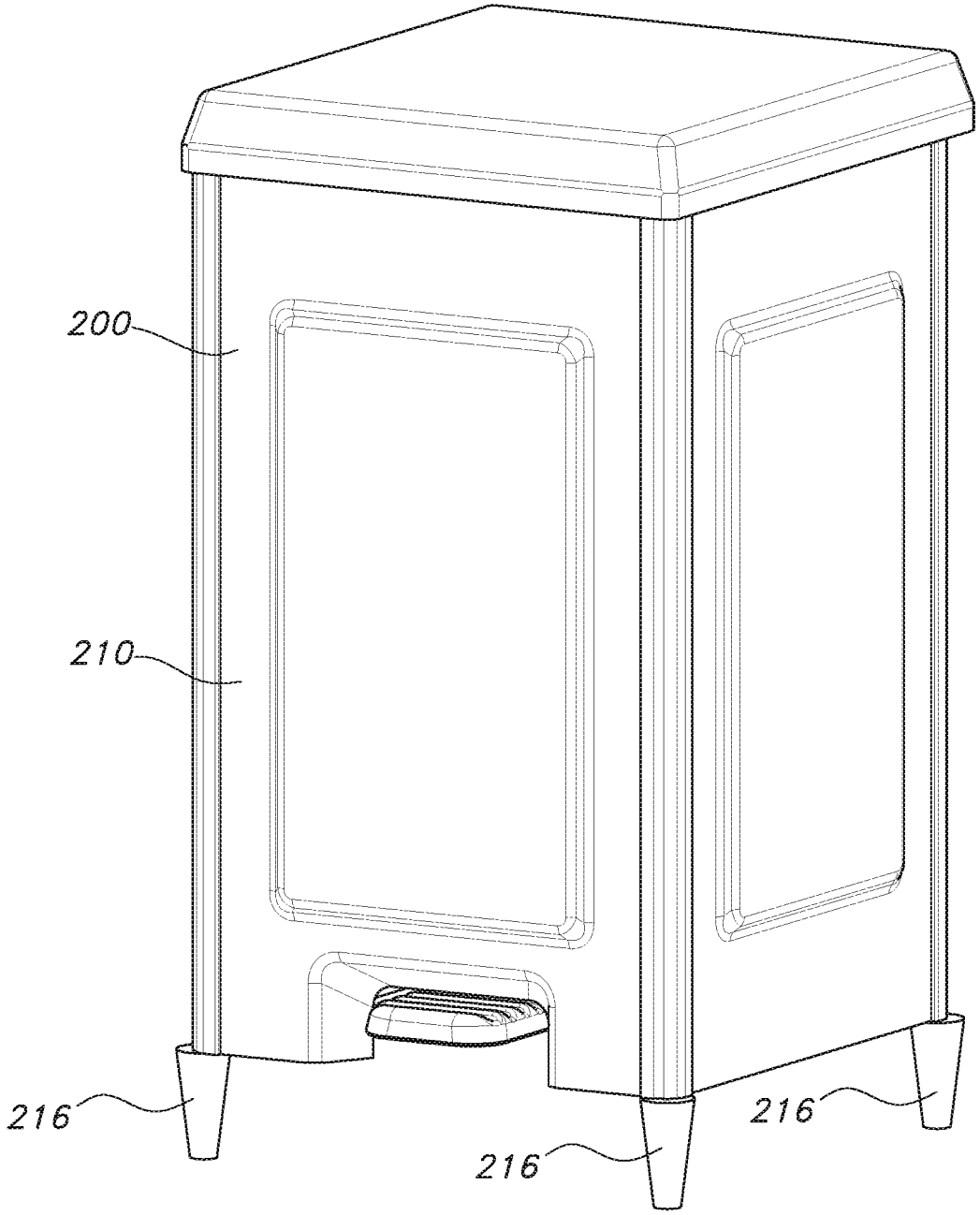
FIG. 7 illustrates an isometric view of the waste receptacle shown in FIG. 4A, wherein detachable stakes have been secured to the underside thereof.
Figure 8:
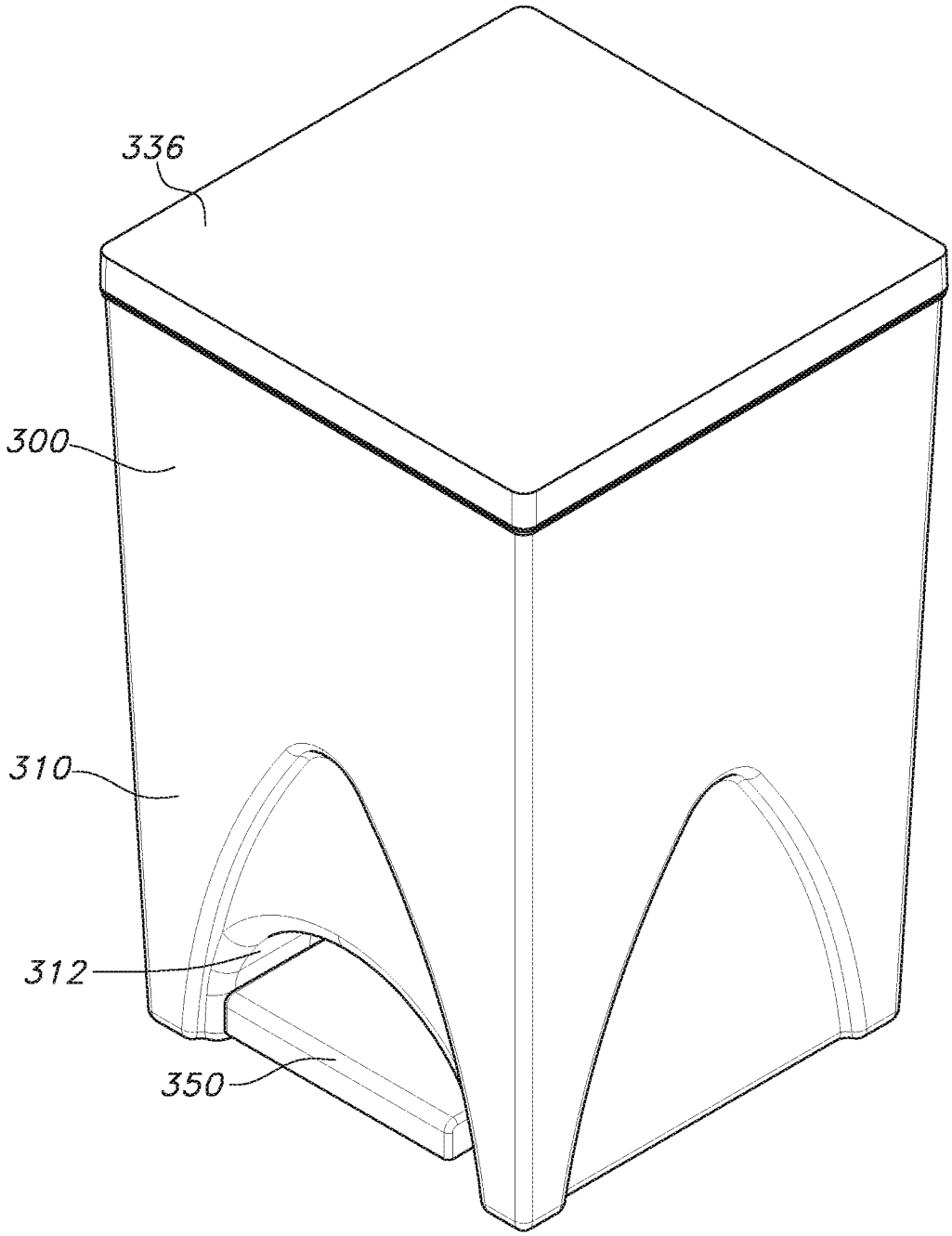
FIG. 8 illustrates an isometric view of yet another waste receptacle constructed in accordance with the principles of the present disclosure.

As shown in FIG. 7, in some implementations, one or more detachable stakes 216 may extend from the bottom of the waste receptacle 200. In this way, the one or more detachable stakes 216 may be driven (or pushed) into the ground and thereby prevent the waste receptacle 200 from tipping over. In some implementations, each detachable stake 216 may be removably secured to the bottom of the body 210 by one or more fasteners (e.g., screws). In some implementations, each detachable stake 216 may be removably secured to the bottom of the body 210 by any suitable method known to one of ordinary skill in the art.

FIGS. 8-13 illustrate yet another example implementation of a waste receptacle 300 constructed in accordance with the present disclosure. In some implementations, the waste receptacle 300 is similar to the waste receptacles 100, 200 discussed above but comprises a body 310, a trash chute member 320 having a hinged cover 330 that is configured to provide selective access to the interior of the body 310, a lid 336 configured to cover the trash chute member 320, and an elastic keeper 340 configured to secure the mouth of a trash bag 305 about the conduit 326 extending from a bottom side of the trash chute member 320. In some implementations, the waste receptacle 300 may further comprise a foot pedal 350 configured to open the lid 336 of the waste receptacle 300.

Figure 13:
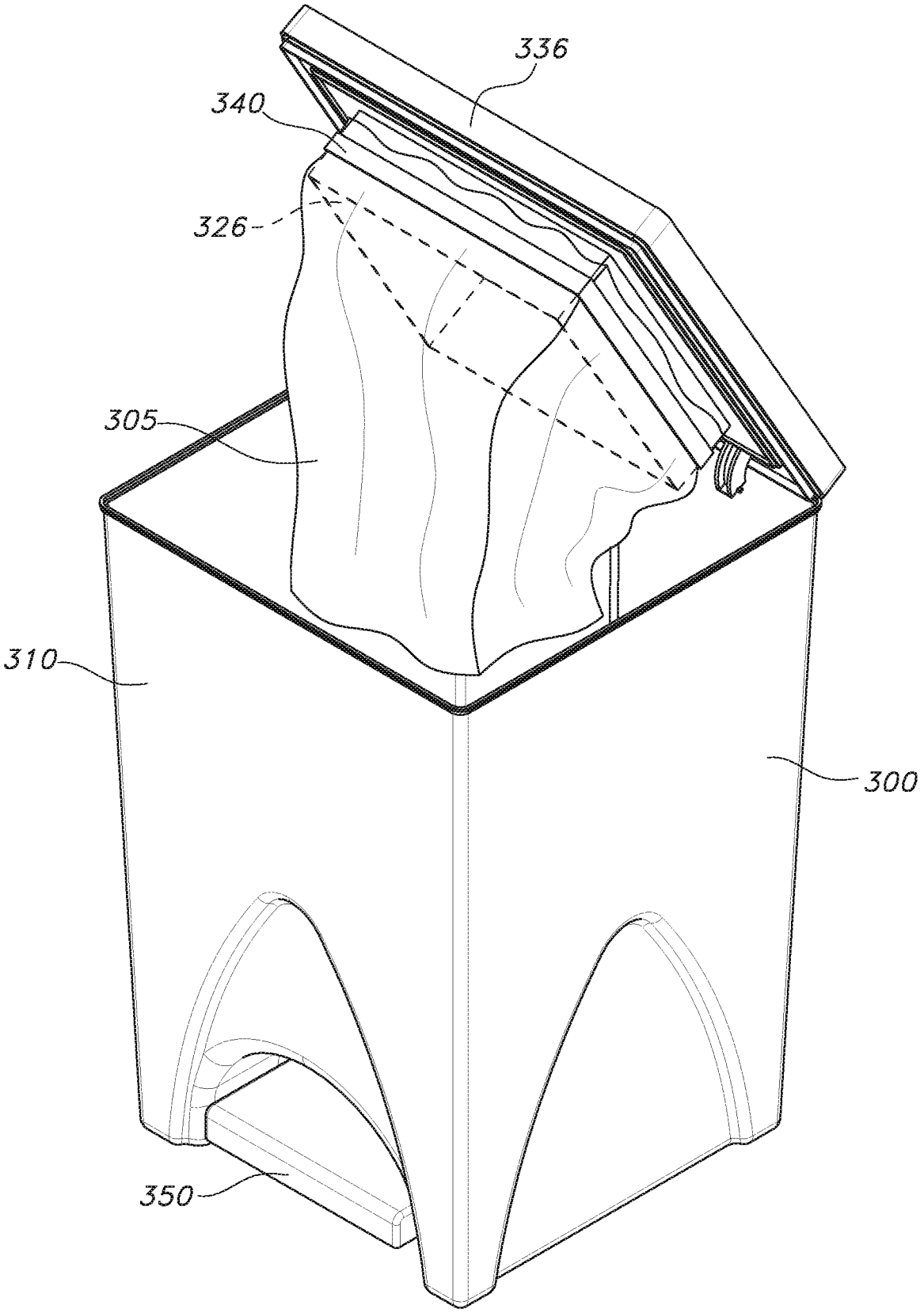
FIG. 13 illustrates an isometric view of the waste receptacle shown in FIG. 12, wherein the mouth of the trash bag is secured about the exterior of the conduit by the keeper.

As shown in FIG. 13, in some implementations, the body 310 of the waste receptacle 300 may be substantially square in shape and have sufficient inner volume to contain a trash bag 305 therein. In some implementations, the body 310 may have a rectangular shape, round shape, or any other shape suitable for housing a trash bag therein.

In some implementations, the trash chute member 320 may be attached to the body 310 of the waste receptacle 300 by a hinge. In some implementations, the hinge may be configured so that the trash chute member 320 can be moved between an open position (see, e.g., FIG. 12) and a closed position (see, e.g., FIG. 11). One of ordinary skill in the art having the benefit of the present disclosure, would be able to select an appropriate hinge.

Figure 10:
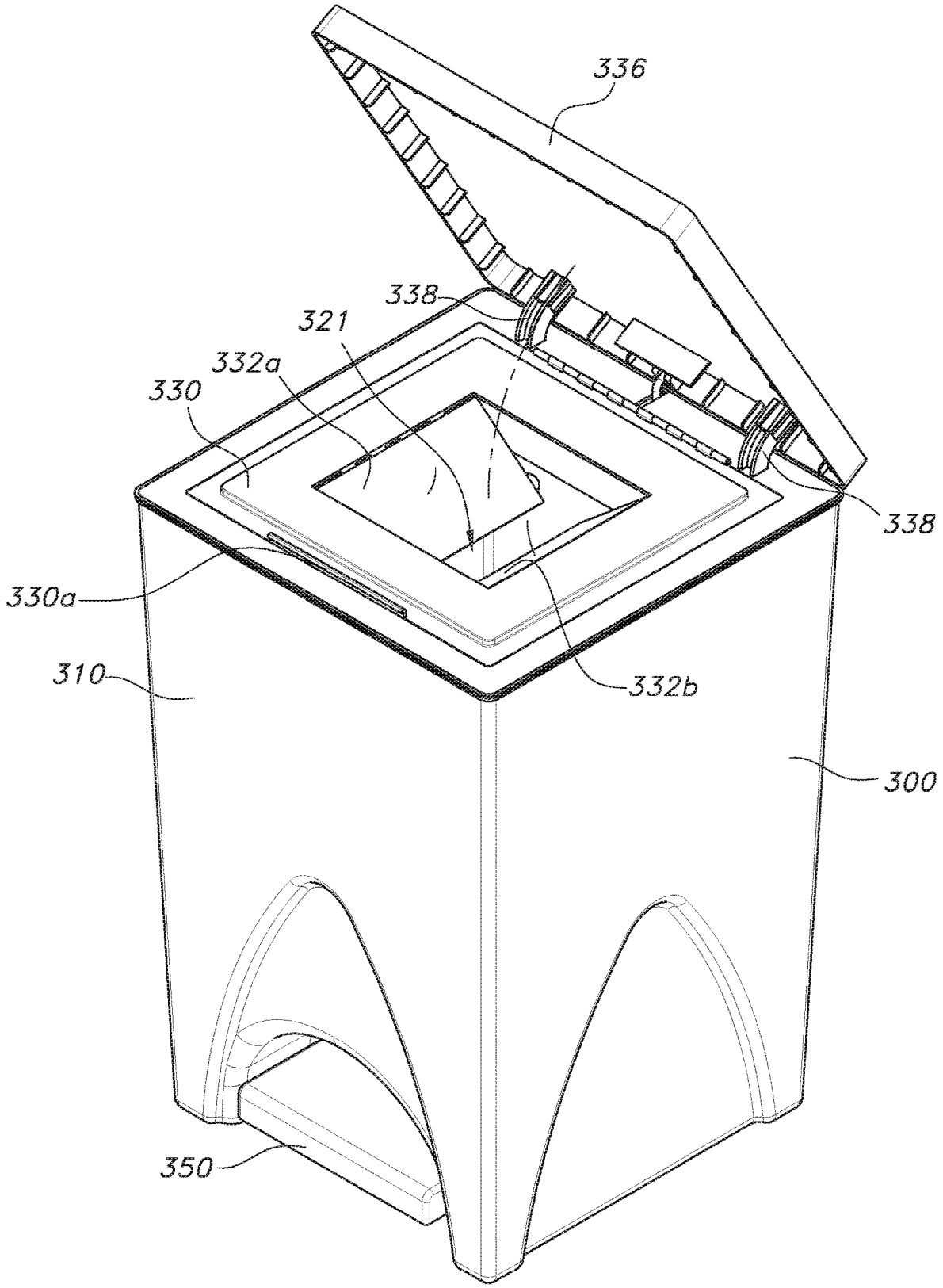
FIG. 10 illustrates an isometric view of the waste receptacle shown in FIG. 9, wherein the doors of the trash chute cover are open.
Figure 11:
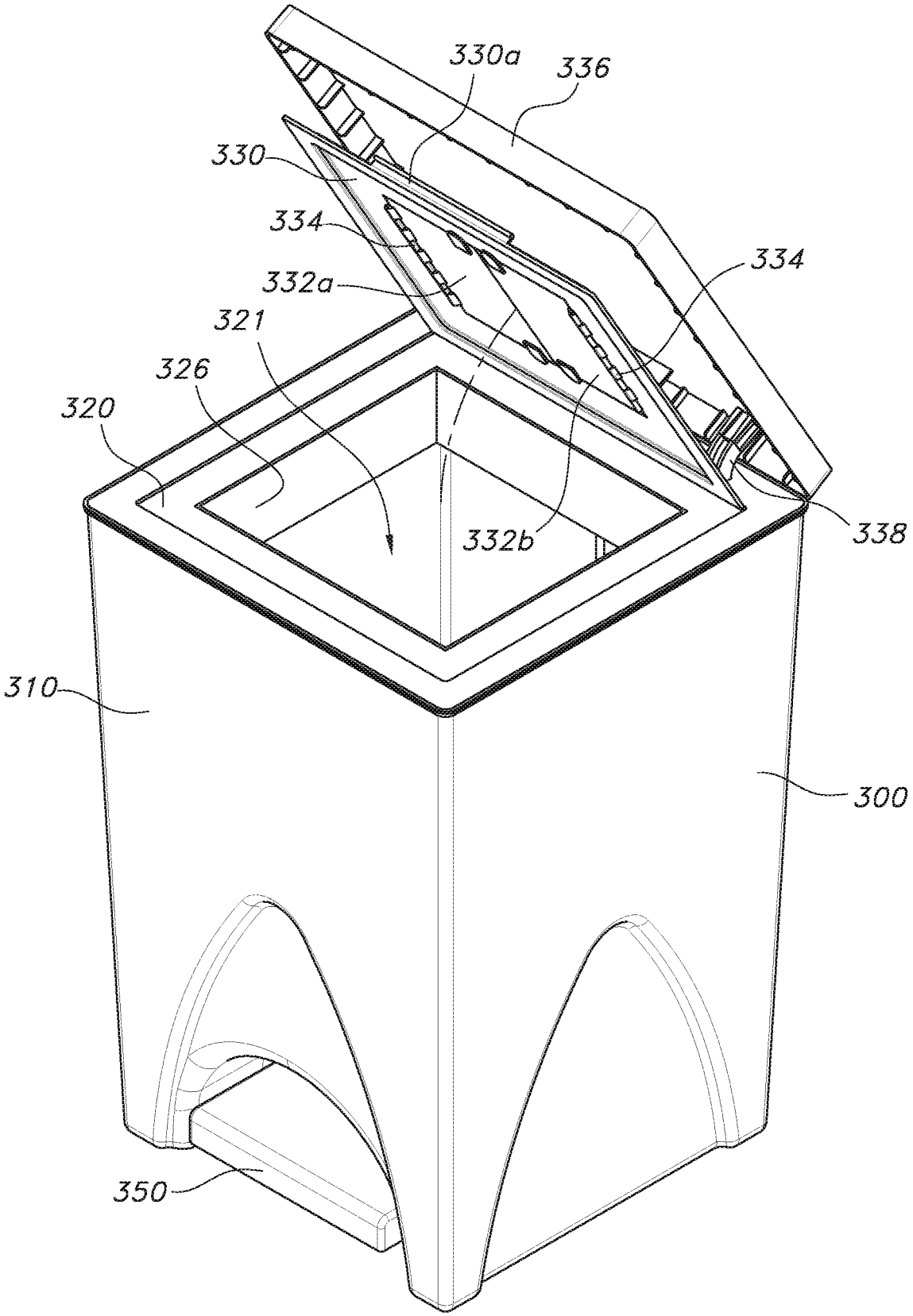
FIG. 11 illustrates an isometric view of the waste receptacle shown in FIG. 9, wherein the trash chute cover is in the open position.

As shown in FIGS. 10 and 11, in some implementations, the trash chute cover 330 may be configured to provide selective access to the opening 321 defined by the conduit 326 of the trash chute member 320. In some implementations, the trash chute cover 330 may include a pair of doors 332*a*, 332*b* that can be pivoted downwardly to permit waste and/or other refuse to be placed into the trash bag 305 housed within the body 310 of the waste receptacle 300 (see, e.g., FIG. 10). In some implementations, each door 332*a*, 332*b* may be attached to the trash chute cover 330 by a hinge 334 that allows it to pivot (see, e.g., FIG. 11). In some implementations, the doors 332*a*, 332*b* may be biased to return to the horizontal position by a spring, or another suitable mechanism known to one of ordinary skill in the art. In some implementations, the trash chute cover 330 may be lifted by a handle 330*a* so that refuse too large to fit through the doors 332*a*, 332*b* thereof can be dropped directly into the opening 321 defied by the conduit 326 of the trash chute member 320 (see, e.g., FIG. 11).

Figure 12:
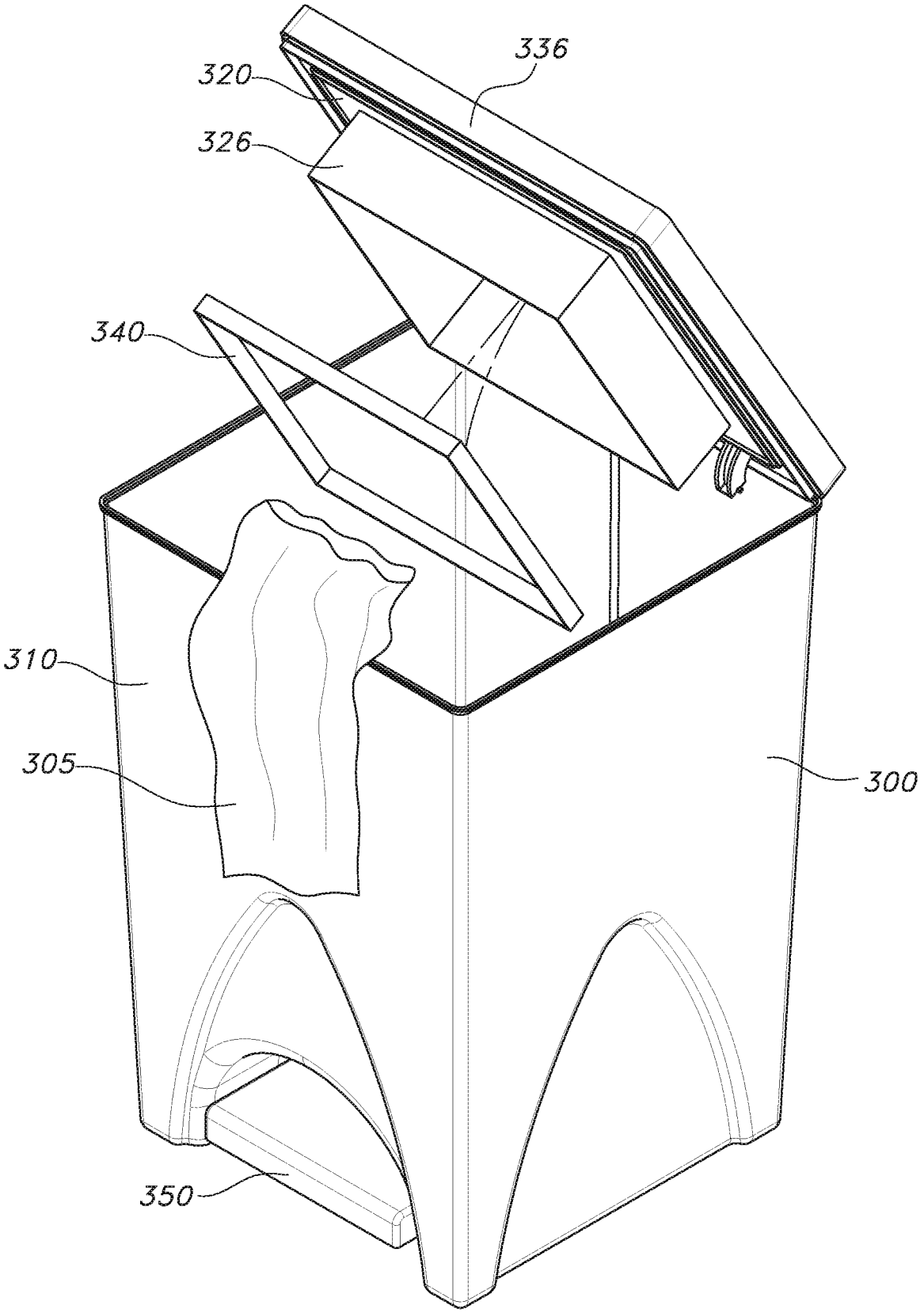
FIG. 12 illustrates an isometric view of the waste receptacle shown in FIG. 11, wherein the trash chute member is in the open position and a trash bag and keeper are shown exploded therefrom.

As shown in FIG. 12, in some implementations, the doors 332*a*, 332*b* of the trash chute cover 330 may be positioned so that the passage defined thereby is aligned with the opening 321 defined by the conduit 326 extending from the bottom side of the trash chute member 320 In this way, waste and/or other refuse passing through the hinged doors 332*a*, 332*b* will pass through the conduit 326 and into the trash bag 305 (see, e.g., FIG. 13). In some implementations, the conduit 326 may have a rectangular shape. In some implementations, the conduit 326 may be any shape suitable for the mouth of a trash bag 305 to be secured thereto by a keeper 340.

Figure 9:
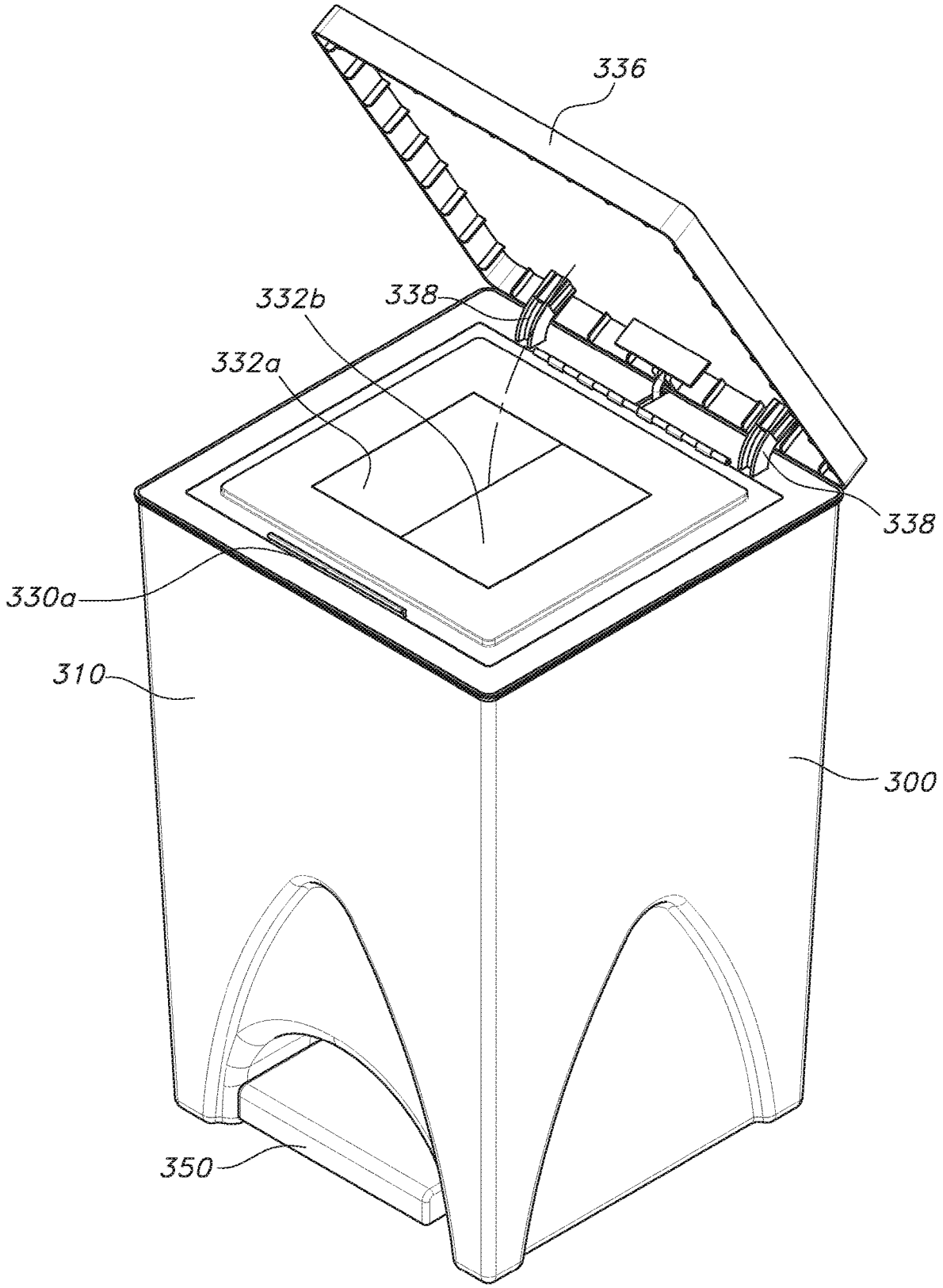
FIG. 9 illustrates an isometric view of the waste receptacle shown in FIG. 8, wherein the top lid is open.

As shown in FIG. 9, in some implementations, the trash chute lid 336 may be attached to the trash chute member 320 by a pair of hinges 338. In some implementations, the hinges 338 may be configured to allow the lid 336 to move between an open position (see, e.g., FIG. 9) and a closed position (see, e.g., FIG. 8). One of ordinary skill in the art, having the benefit of the present disclosure, would be able to select an appropriate hinge 338.

While the lid 336 may be lifted and lowered manually, in some implementations, the waste receptacle 300 includes a foot pedal 350 that is operably coupled to the lid 336. In this way, the lid 336 can be lifted by stepping on the foot pedal 350. In some implementations, the lid 336 may close once the user removes their foot from the foot pedal 350. In some implementations, the foot pedal 350 may protrude into a pedal housing 312 located within a frontside of the body 310. In some implementations, the pedal housing 312 has a height and width that allows a user to slide their foot into the pedal housing 312 and onto the foot pedal 350. The linking mechanism operably coupling the foot pedal 350 to the lid 336 is not critical to the design of the present invention. Therefore, the waste receptacle 300 could be configured to include any suitable linking mechanism, known to one of ordinary skill in the art, that is capable of lifting the lid 336 when the foot pedal 350 is stepped on.

As shown in FIGS. 12 and 13, in some implementations, the keeper 340 may be an elastic band that is configured to fit snugly about the exterior of the conduit 326 extending from the bottom side of the trash chute member 320. In this way, the mouth of a trash bag 305 may be secured about the conduit 326. In some implementations, the keeper 340 (i.e., the elastic band) may have any shape suitable for being secured about the exterior of the conduit 326 while holding the mouth of a trash bag 305 in position thereon.

In some implementations, the keeper 340 may be made of a silicone material (e.g., silicone rubber), but can be made of another suitable elastic material.

In some implementations, the following steps may be used to secure the mouth of a trash bag 305 in position about the conduit 326 extending from the bottom side of the trash chute member 320.

Initially, in some implementations, the trash chute member 320 of the waste receptacle 300 may be moved to the open position (see, e.g., FIG. 12).

Then, in some implementations, the mouth of the trash bag 305 may be pulled through the interior opening of the keeper 340 and positioned about the exterior of the conduit 326 extending from the bottom side of the trash chute member 320 (see, e.g., FIGS. 12 and 13).

Next, in some implementations, the keeper 340 may be stretched to encircle the portion of the trash bag that is positioned about the exterior of the conduit. In this way, due to the elastic (or resilient) nature of the keeper 340, the mouth of the trash bag 305 is secured about the exterior of the conduit 326.

While a trash bag is described for use in connection with the waste receptacles 100, 200, 300 disclosed herein, it should be understood that any bag having a mouth configured to fit about the conduit 126, 226, 326 of a trash chute member 120, 220, 320 could be used therewith.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A waste receptacle comprising:

a body that defines an interior;

a trash chute member attached to the body by a hinge, the hinge is configured so the trash chute member can be moved between an open position and a closed position, the trash chute member includes a cover configured to provide selective access to the interior of the body and a conduit extending from a bottom side thereof;

a lid configured to cover the trash chute member; and a keeper configured to secure a mouth of a trash bag about the conduit extending from the bottom side of the trash chute member;

wherein the cover is attached to the trash chute member by a hinge, the hinge is configured so the cover can be moved between an open position that allows access to an opening defined by the conduit of the trash chute member and a closed position;

wherein the cover of the trash chute member includes at least one hinged door that provides selective access to the opening defined by the conduit of the trash chute member.

2. The waste receptacle of claim 1, further comprising a foot pedal that is operably coupled to the lid, the foot pedal is configured to open the lid when stepped on.

3. The waste receptacle of claim 1, wherein the keeper is configured to fit snugly about an exterior of the conduit while holding the mouth of a trash bag thereon.

4. The waste receptacle of claim 1, wherein the keeper is an elastic band configured to fit about an exterior of the conduit while holding the mouth of a trash bag thereon.

5. The waste receptacle of claim 1, wherein the keeper is a wire clamp configured to fit about an exterior of the conduit while holding the mouth of a trash bag thereon.

6. The waste receptacle of claim 5, wherein the wire clamp is a resilient piece of material having a first end and a second end.

* * * * *